US005333457A

United States Patent [19]

Silvestri, Jr.

[11] Patent Number: 5,333,457

[45] Date of Patent: Aug. 2, 1994

[54] OPERATION BETWEEN VALVE POINTS OF A PARTIAL-ARC ADMISSION TURBINE

[75] Inventor: George J. Silvestri, Jr., Winter Park, Fla.

[73] Assignee: Westinghouse Electric Corporation, Pittsburgh, Pa.

[21] Appl. No.: 891,338

[22] Filed: May 29, 1992

Related U.S. Application Data

[63] Continuation-in-part of Ser. No. 772,505, Oct. 7, 1991, Pat. No. 5,136,848.

[51] Int. Cl.[5] ..... F01K 13/02

[52] U.S. Cl. ..... 60/646; 60/657

[58] Field of Search ..... 60/646, 657

[56] References Cited

U.S. PATENT DOCUMENTS

| | | | |
|---|---|---|---|
| 4,297,848 | 11/1981 | Silvestri, Jr. | 60/660 |
| 4,320,625 | 3/1982 | Westphal et al. | 60/646 |
| 4,888,954 | 12/1989 | Silvestri, Jr. | 60/660 |
| 5,136,848 | 8/1992 | Silvestri, Jr. | 60/646 |

OTHER PUBLICATIONS

Stodola; "Steam and Gas Turbines With A Supplement On The Prospects Of The Thermal Prime Mover"; McGraw-Hill Book Co., Inc.; vol. 1, pp. 189-190.

Erbes & Eustis; "A Computer Methodology For Predicting The Design and Off-Design Performance of Utility Steam Turbine Generators"; Proceedings of the American Power Conference, Illinois Institute of Technology; 1986; vol. 48, pp. 318-320.

Silvestri, Jr.; "Steam Cycle Performance'"; Power Division, American Society of Mechanical Engineers; pp. 9-10.

Silvestri, Jr. et al.; "Recent Developments in the Application of Partial-Arc Turbines to Cyclic Service"; Electric Power Institute; Oct. 20-22, 1987; pp. 1-20.

Silvestri, Jr. et al.; "An Update on Partial-Arc Admission Turbines for Cycling Applications"; Electric Power Research Institute; Nov. 5-7, 1985; pp. 1-23.

*Primary Examiner*—Edward K. Look
*Assistant Examiner*—James A. Larson
*Attorney, Agent, or Firm*—G. R. Jarosik

[57] ABSTRACT

A method for improving operational efficiency of a partial-arc steam turbine power plant during power output variations by dynamically adjusting valve point values during turbine operation. Impulse chamber pressure at each of a plurality of valve points is first determined during operation of the steam turbine at constant pressure. For each adjacent pair of valve points, an optimum constant pressure transition point pressure for transitioning from one to the other of the sliding pressure mode and constant pressure mode is then computed. The optimum constant pressure transition point pressure for each pair of valve points is converted to a corresponding percentage of the pressure difference between the adjacent pairs of valve points. The impulse chamber pressure at each valve point is then used to calculate a corresponding impulse chamber pressure for transitioning from the one mode to the other mode based upon the percentage pressure difference. During the transition, the control valve associated with the transition point and valve point is gradually closed.

4 Claims, 3 Drawing Sheets

OPERATION BETWEEN VALVE POINTS OF A PARTIAL-ARC ADMISSION TURBINE

This is a continuation in part of U.S. patent application Ser. No. 07, 772,505, filed Oct. 7, 1991, U.S. Pat. No. 5,136,845.

The present invention relates to steam turbines in power utility applications and, more particularly, to a method for optimizing steam turbine performance during power output demand variations.

BACKGROUND OF THE INVENTION

The power output of many multi-stage steam turbine systems is controlled by sliding pressure control of steam from a steam generator in order to reduce the pressure of steam at the high pressure turbine inlet or steam chest. Steam turbines which utilize this sliding pressure method are often referred to as full arc turbines because all steam inlet nozzle chambers are active at all load conditions. Full arc turbines are usually designed to accept exact steam conditions at a rated load in order to maximize efficiency. By admitting steam through all of the inlet nozzles, the pressure ratio across the inlet stage, e.g., the first control stage, in a full arc turbine remains essentially constant irrespective of the steam inlet pressure. As a result, the mechanical efficiency of power generation across the first control stage may be optimized. However, as power is decreased in a full arc turbine, there is an overall decline in efficiency, i.e., the ideal efficiency of the steam work cycle between the steam generator and the turbine output, because sliding pressure reduces the energy available for performing work. Generally, the overall turbine efficiency, i.e., the actual efficiency is a product of the ideal and the mechanical efficiency of the turbine.

More efficient control of turbine output than is achievable by the sliding pressure method only has been realized by the technique of dividing steam which enters the turbine inlet into isolated and individually controllable arcs of admission. In this method, known as partial-arc admission, the number of active first stage nozzles is varied in response to load changes. Partial arc admission turbines have been favored over full arc turbines because a relatively high ideal efficiency is attainable by sequentially admitting steam through individual nozzle chambers at constant pressure, rather than by sliding pressure over the entire arc of admission. The benefits of this higher ideal efficiency are generally more advantageous than the optimum mechanical efficiency achievable across the control stage of full arc turbine designs. Overall, multi-stage steam turbine systems which use partial-arc admission to vary power output operate with a higher actual efficiency than systems which vary steam pressure across a full arc of admission. However, partial-arc admission systems in the past have been known to have certain disadvantages which limit the efficiency of work output across the control stage. Some of these limitations are due to unavoidable mechanical constraints, such as, for example, an unavoidable amount of windage and turbulence which occurs as rotating blades pass nozzle blade groups which are not admitting steam.

Furthermore, in partial-arc admission systems the pressure drop (and therefore the pressure ratio) across the nozzle blade groups varies as steam is sequentially admitted through a greater number of valve chambers, the largest pressure drop occurring at the minimum valve point (fewest possible number of governor or control valves open) and the smallest pressure drop occurring at full admission. The thermodynamic efficiency, which is inversely proportional to the pressure differential across the control stage, is lowest at the minimum valve point and highest at full admission. Thus, the control stage efficiency for partial-arc turbines decreases when power output drops below the rated load. However, given the variable pressure drops across the nozzles of a partial-arc turbine, it is believed that certain design features commonly found in partial-arc admission systems can be improved upon in order to increase the overall efficiency of a turbine. Because the control stage is an impulse stage wherein most of the pressure drop occurs across the stationary nozzles, a one percent improvement in nozzle efficiency will have four times the effect on control stage efficiency as a one percent improvement in the efficiency of the rotating blades. Turbine designs which provide even modest improvements in the performance of the control stage nozzles will significantly improve the actual efficiency of partial-arc turbines. At their rated loads, even a 0.25 percent increase in the actual efficiency of a partial-arc turbine can result in very large energy savings.

Sliding or variable throttle pressure operation of partial-arc turbines within some valve loops also results in improved turbine efficiency and additionally reduces low cycle fatigue. The usual procedure is to initiate sliding pressure operation on a partial-arc admission turbine at flows below the value corresponding to the point where half the control valves are wide open and half are fully closed, i.e., 50% first stage admission on a turbine in which the maximum admission is practically 100%, if sliding pressure is used to the lowest available pressure limit. In comparison, sliding pressure operation is most efficient in a full arc turbine when initiated at maximum steam flow. If sliding pressure is initiated in a partial-arc turbine at a higher flow (larger value of first stage admission), there is a loss in performance. However, in a turbine having multiple valves, sliding from any admission above 50% eliminates a considerable portion of each of the valve loops (valve throttling) which would occur with constant throttle pressure operation. Elimination of such valve loops improves the turbine heat rate and its efficiency.

FIG. 1 illustrates the effect of sliding pressure control in a partial-arc steam turbine having eight control valves. The abscissa represents values of load while the ordinate values are heat rate. Line 14 represents a locus of ideal points for constant pressure with sequential valve control (partial-arc admission) operation. Dotted lines 16, 18, and 20 represent actual valve loops for a finite number of valves. The valve loops result from gradual throttling of each of a sequence of control or governor valves. Sliding pressure operation from 100% admission is indicated by line 22. Note that some of the valve loop 16 is eliminated by sliding pressure along line 22 but that heat rate (the reciprocal of efficiency) increases disproportionately below the transition point 24. Line 26, showing sliding pressure from the 87.5% admission point, provides similar improvement for valve loop 18 down to transition point 28. Similarly, sliding from 75% admission, line 30, improves operation over valve loop 20. Each of these valve loops represents higher heat rates and reduced efficiency from the ideal curve represented by line 14. Each valve point on line 14 represents a condition in which each valve is either fully open or fully closed.

FIGS. 1, 2, and 3 illustrate the operation of an exemplary steam turbine using one prior art control. FIG. 1 shows the locus of full valve points, line 14, with constant pressure operation at 2535 psia. The valve points are identified at 50%, 75%, 87.5% and 100% admission with the valve loops identified by the lines 16, 18, and 20. Sliding pressure is indicated by lines 22, 26 and 30. Starting at 100% admission, about 806 MW for the exemplary turbine system, load is initially reduced by keeping all eight control valves wide open and sliding throttle pressure by controlling the steam producing boiler. When the throttle pressure, line 22, reaches the intersection point 24 with the valve loop 16, the throttle pressure is increased to 2535 psia while closing the eighth control valve to an admission value corresponding to point 24. The control valve would continue to close as load is further reduced while maintaining a constant 2535 psia throttle pressure until this valve is completely closed at which point the turbine is operating at 87.5% admission. To further reduce load, valve position is again held constant, seven valves fully open, and throttle pressure is again reduced until the throttle pressure corresponds to the intersection of the sliding pressure line 26 and the valve loop 18 at point 28. To reduce load below point 28, the pressure is increased to 2535 psia and the seventh valve is progressively closed (riding down the valve loop) until it is completely closed. The admission is now 75%. To reduce load still further, the pressure is again reduced with six valves wide open and two fully closed until the sliding pressure line 30 reaches the intersection point 32 with the valve loop 20. Then the operation of raising throttle pressure and closing of a control valve is repeated for any number of valve loops desired. The variation in throttle pressure is illustrated in FIG. 2. The sloped portions 44 of line 46 correspond to sliding pressure operation with constant valve position. The vertical portions 48 correspond to termination of sliding pressure and transition to valve throttling. The horizontal portions 50 correspond to operation at constant steam pressure with control valve throttling such as by riding down the valve loop while reducing load at constant pressure. FIG. 3 shows the improvement in heat rate as a function of load. The line 52 represents the difference between valve loop performance at constant pressure and the performance using sliding pressure between valve points.

The performance improvements shown in FIGS. 1 and 3 are based on the assumption that the boiler feed pump discharge is reduced as the throttle pressure is reduced. If it is not reduced proportionally, the improvement is reduced since the energy required to maintain discharge pressure remains high. In the prior art system, a signal is sent to the feed pump-feed pump drive system to reduce pressure. In reality, however, the feed pump is followed by a pressure regulator in order to eliminate the need for constant adjustment of pump speed and the occurrence of control instability and hunting because of small variations in inlet water pressure to the boiler, resulting from perturbations in flow demand. The regulator, then, does more or less throttling which changes pump discharge pressure and therefore the flow that the pump will deliver. The pump speed is held constant over a desired range of travel of the regulator valve. When the valve travel gets outside these limits, the pump speed is adjusted to move the valve to some desired mean position. As a consequence, the pump discharge pressure does not equal the minimum allowable value (throttle pressure plus system head losses) and so the performance improvement is not as large as shown by FIGS. 1 and 3. In addition, in order to achieve quicker load response, the regulator valve is usually operated with some pressure drop so that if there is a sudden increase in load demand, the valve can open quickly and increase flow. The response of the pump and its drive is slower than the response of the regulator valve.

While the combination of sliding throttle pressure and control valve positioning provides a significant improvement in heat rate, Applicant has found that the optimum transition point for switching from one mode to the other varies from turbine to turbine and over the life of a turbine. In particular, in addition to the factors mentioned above, other parameters such as condenser pressure, reheat temperature, and reheater pressure drop may vary from design values. Such variations cause a shift in the load at which transition occurs. Moreover, because of blading manufacturing tolerances, the transition points (loads) when going from sliding to constant throttle pressure operation differ from those obtained from performance calculations.

U.S. Pat. No. 4,297,848, issued Nov. 3, 1981 and assigned to the assignee of the present invention, attempted to overcome the optimization problem by using impulse chamber pressure to establish the transition point. The procedure described therein required perturbing the boiler pressure and measuring the electrical load. Because of uncertainties in load measurement and complexity of the perturbation, the transition point may occur at a less than optimum value.

SUMMARY OF THE INVENTION

In accordance with the general principles of the present invention, there is disclosed a method for optimizing the transition points between sliding pressure and constant throttle pressure operation in a partial-are steam turbine. In particular, impulse chamber pressure is used to effect transitioning between sliding and constant pressure operation. However, during power reduction, impulse chamber pressure for sliding pressure operation is adjusted in accordance with a predetermined pressure-volume relationship so as to correspond to values of constant pressure operation. Applicant has found that impulse chamber pressure is higher with sliding pressure operation than with constant throttle pressure operation. Since the valve points, i.e., the points at which a selected valve is fully closed and fully opened, are determined during constant throttle pressure operation, without adjustment of the impulse chamber pressure readings during sliding pressure operation, the transition point would occur at a non-optimum impulse chamber pressure.

The inventive method further utilizes measurements of impulse chamber pressure at each valve point during turbine operation to set the optimum transition point. More particularly, Applicant has found that the optimum transition point is generally a predetermined percentage of the pressure difference between adjacent valve points. Accordingly, by dynamically establishing valve points, Applicant is able to effect a transition at an optimum point by computing a percentage of the difference in pressure and using that difference to set the transition point.

The present invention also includes the method of reducing rotor thermal stress when transitioning from variable pressure operation to constant pressure operation at the computed optimum transition point. In particular, in accordance with the preferred method of operation, steam pressure is reduced in accordance with a reduction in power demand until the pressure reaches the predetermined optimum transition point. At that point, the control valve is gradually closed thereby decreasing steam flow into the steam turbine while simultaneously increasing steam pressure gradually so that full throttle steam pressure is not reached until the control valve which is being operated has reached its fully closed position. This method is believed to also improve the system efficiency. Shock loading of control stage blading is also improved since full steam pressure is not immediately reapplied to the control stage at the transition point. If further reductions in turbine power output are required, the above method is simply repeated for each control valve, i.e., the throttle pressure is reduced until the optimum transition point is reached and thereafter the control valve is gradually closed while simultaneously gradually increasing throttle steam pressure.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 4:
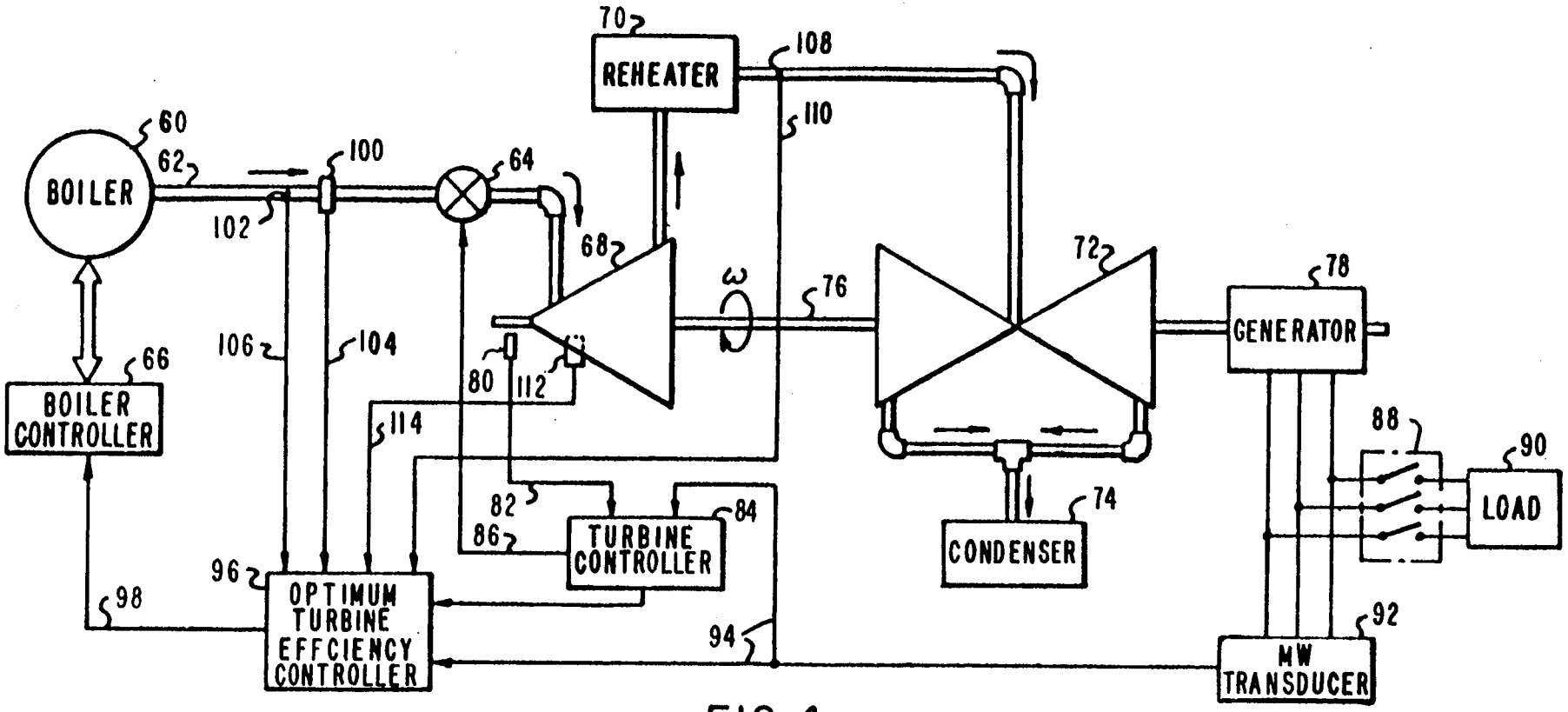
FIG. 4 PRIOR ART
FIG. 4 is a simplified illustration of one form of steam turbine power plant suitable for implementing the method of the present invention.

Before turning to the present invention, reference is first made to FIG. 4 which depicts a functional block diagram schematic of a typical steam turbine power plant suitable for embodying the principles of the present invention. In the plant of FIG. 4, a conventional boiler 60, which may be of a nuclear fuel or fossil fuel variety, produces steam which is conducted through a throttle header 62 to a set of steam admission valves depicted at 64. Associated with the boiler 60 is a conventional boiler controller 66 which is used to control various boiler parameters such as the steam pressure at throttle 62. More specifically, the steam pressure at the throttle 62 is usually controlled by a set point controller (not shown in FIG. 4) disposed within the boiler controller 66. Such a set point controller arrangement is well known to those skilled in the pertinent art and therefore requires no detailed description of the present embodiment. Steam is regulated through a high pressure section 68 of the steam turbine in accordance with the positioning of the steam admission valves (control valves) 64 which are positioned to control steam flow from an accumulator (steam chest) to the various areas of admission of the turbine section 68. Normally, steam exiting the high pressure turbine section 68 is reheated in a conventional reheater section 70 prior to being supplied to at least one lower pressure turbine section shown at 72. Steam exiting the turbine section 72 is conducted into a conventional condenser unit 74.

In most cases, a common shaft 76 mechanically couples the steam turbine sections 68 and 72 to an electrical generator unit 78. As steam expands through the turbine sections 68 and 72, it imparts most of its energy into torque for rotating the shaft 76. During plant start-up, the steam conducted through the turbine sections 68 and 72 is regulated to bring the rotating speed of the turbine shaft to the synchronous speed of the line voltage or a subharmonic thereof. Typically, this is accomplished by detecting the speed of the turbine shaft 76 by a conventional speed pickup transducer 80. A signal 82 generated by transducer 80 is representative of the rotating shaft speed and is supplied to a conventional turbine controller 84. The controller 84 in turn governs the positioning of the steam admission valves using signal lines 86 for regulating the steam conducted through the turbine sections 68 and 72 in accordance with a desired speed demand and the measured speed signal 82 supplied to the turbine controller 84.

A typical main breaker unit 88 is disposed between the electrical generator 78 and an electrical load 90 which, for the purposes of the present description, may be considered a bulk electrical transmission and distribution network. When the turbine controller 84 determines that a synchronization condition exists, the main breaker 88 may be closed to provide electrical energy to the electrical load 90. The actual power output of the plant may be measured by a conventional power measuring transducer 92, like a watt transducer, for example, which is coupled to the electrical power output lines supplying electrical energy to the load 90. A signal which is representative of the actual power output of the power plant is provided to the turbine controller 84 over signal line 94. Once synchronization has taken place, the controller 84 may conventionally regulate the steam admission valves 64 to provide steam to the turbine sections 68 and 72 commensurate with the desired electrical power generation of the power plant.

In accordance with the present invention, an optimum turbine efficiency controller 96 is additionally disposed as part of the steam Dower plant of FIG. 4. The controller 96 monitors the thermodynamic conditions of the plant at a desired power plant output by measuring various turbine parameters as will be more specifically described hereinbelow and with the benefit of this information governs the adjustment of the throttle steam pressure utilizing the signal line 98 coupled from the controller 96 to the boiler controller 66. The throttle pressure adjustment may be accomplished by altering the set point of the throttle set point controller (not shown) which is generally known to be a part of the boiler controller 66. As may be the case in most set point controllers, the feedback measured parameter, like throttle steam pressure, for example, is rendered substantially close to the set point, the deviation usually being a function of the output/input gain characteristics of the pressure set point controller.

Turbine parameters, like throttle steam pressure and temperature, are measured respectively by conventional pressure transducer 100 and temperature transducer 102. Signals 104 and 106 generated respectively by the transducers 100 and 102 may be provided to the optimum turbine efficiency controller 96. Another parameter, the turbine reheat steam temperature at the reheater 70, is measured by a conventional temperature transducer 108 which generates a signal 110 may also be provided to the controller 96 for use thereby. The signal 94 which is generated by the power measuring transducer 92 may be additionally provided to the controller 96. Moreover, an important turbine parameter is one which reflects the steam flow through the turbine sections 68 and 72. For the purposes of the present embodiment, the steam pressure at the impulse chamber (first stage exit) of the high pressure turbine section 68 is suitably chosen for the purpose. A conventional pressure transducer 112 is disposed at the impulse chamber section for generating and supplying a signal 114, which is representative of the steam pressure at the impulse chamber to the controller 96.

The controller 96 for purposes of this application, may be considered to be the primary control device in the above described coordinated plant control system and typically includes a microcomputer such as, for example, a MicroVax computer available from Digital Equipment Corporation. This computer is capable of performing the calculations necessary to effect control of the turbine system.

Figure 1:
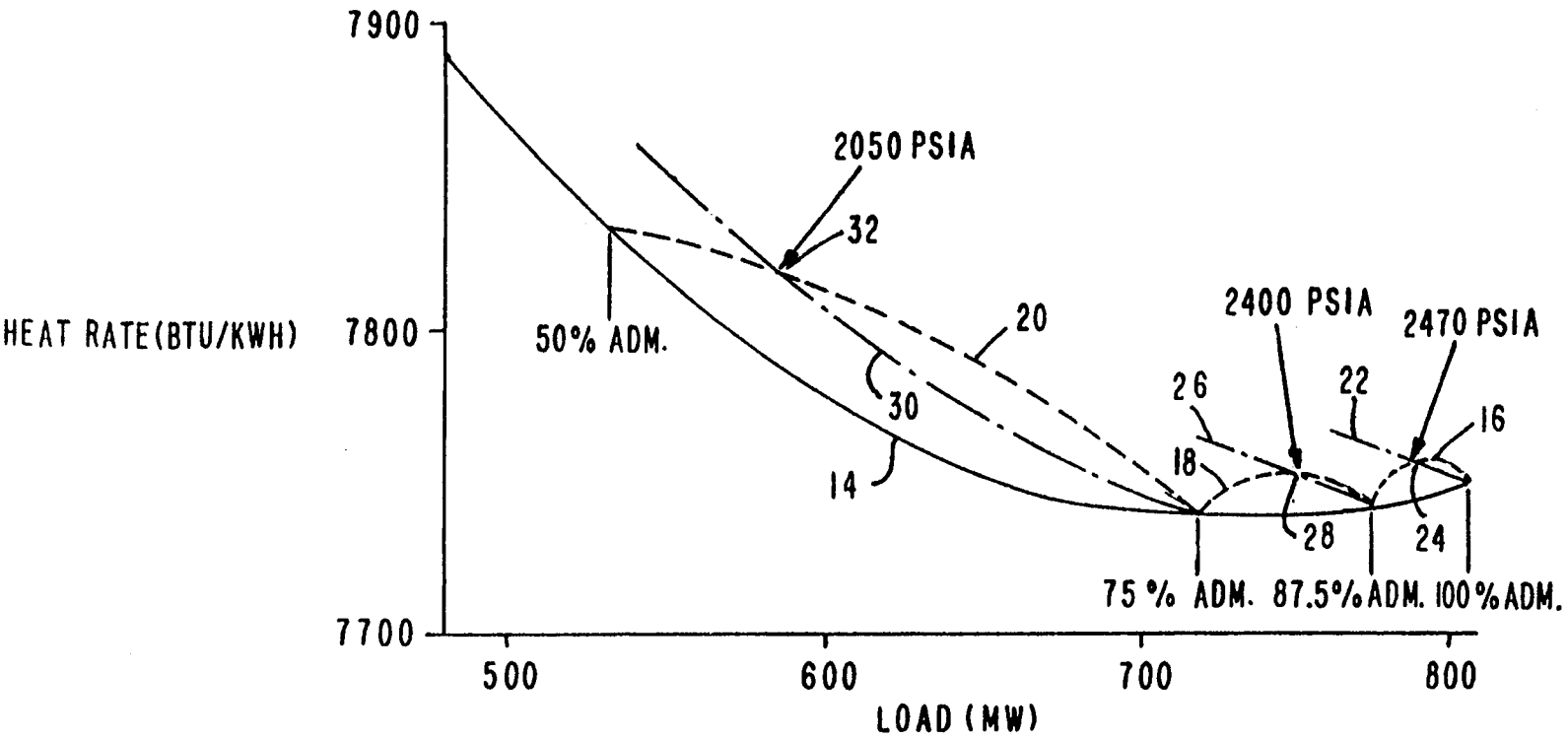
FIG. 1 PRIOR ART
FIG. 1 is a sequence of turbine output or load versus heat rate curves characteristic of one prior art method of steam turbine control.

Referring again to FIG. 1, it is desirable to combine sliding pressure operation with constant pressure operation to obtain an optimum efficiency or heat rate. In an ideal environment, the point at which each control valve should open or close can be calculated from the turbine design and, in fact, each turbine manufacturer has its own method of computing the ideal valve points and ideal transition points as a function of load (or other variable) for each turbine which is constructed using the design parameters for such turbine. This design computation is used to create the graph of FIG. 1. However, various factors such as manufacturing tolerances in blading and turbine parameters such as condenser pressure and reheater temperature and pressure can combine to cause the ideal valve points and the ideal transition points to occur at other than calculated values. It is therefore necessary for the controller 96 to include the computational capability to modify the values of FIG. 1 based upon the actual measured values. Furthermore, it has been found that impulse chamber pressure is higher during sliding pressure operation than during constant throttle pressure operation due to higher enthalpy and specific volume. Accordingly, since valve points are necessarily set during constant throttle pressure operation, the transition point on each control valve curve is defined in terms of constant throttle pressure. While this is not a concern if the turbine load is increasing, since the transition is from constant throttle pressure to sliding pressure, it is a concern during decreasing load when the transition is from sliding pressure to constant pressure operation. It is therefore necessary, if an optimum transition point is selected, to convert impulse chamber pressure during sliding pressure operation to an equivalent constant throttle pressure value.

Applicant has found that if impulse chamber pressure at constant throttle pressure is multiplied by the square root of the ratio of the pressure-volume (PV) products for each mode of operation, the result is a pressure that closely matches that corresponding to sliding pressure operation. Mathematically, it can be shown that:

$$P_{is} = P_{ic}\sqrt{\frac{(PV)_S}{(PV)_C}}$$

where $P_{ic}$=Impulse chamber pressure @ constant throttle pressure.

$P_{is}$=Impulse chamber pressure @ sliding throttle pressure.

$(PV)_S$=Impulse chamber pressure-volume product @ sliding throttle pressure.

$(PV)_C$=Impulse chamber pressure-volume product @ constant throttle pressure.

A less exact relationship replaces the PV product by the impulse chamber temperature in degrees absolute.

$$P_{is} = P_{ic}\sqrt{\frac{(TAB)_S}{(TAB)_C}}$$

The accuracy of this method was verified further by considering a situation in which the blading flow areas deviate from the design values. Calculations were made to determine the transition point when the turbine flow areas exactly conformed to the design areas and when two variations were introduced. With the one variation, the flow areas of the first six rows of reaction blading of the HP elements 68 (out of the total eighteen rows) were increased by 5%. With the second variation, the nozzle area of the control stage was increased by 2%.

Table 1 and Table 2 show the impulse chamber pressure for constant and sliding pressure at the transition point with the three sets of flow areas for a 440 MW turbine with six control valves. Table 1 relates to the valve that supplies the 83.3% to 100.0% admission arc with steam. Table 2 relates to the valve that supplies steam to the 50% to 66.7% admission arc. The amount of steam that passes through the nozzles of a given arc of admission increases as the unit load decreases until the nozzle choke (have critical pressure ratio). In addition, the impulse chamber temperature decreases as load decreases.

TABLE 1

| | (NUMBER 6 VALVE) | |
|---|---|---|
| | IMPULSE CHAMBER PRESSURE | |
| BLADING AREA | CONSTANT P | SLIDING P |
| Drawing Values | 1780.1 psia (125.13 Kg/cm$^2$) | 1787.1 psia (125.65 Kg/cm$^2$) |
| 5% Increase (Reaction to Blading) | 1761.9 psia (123.87 Kg/cm$^2$) | 1769.1 psia (124.38 Kg/cm$^2$) |
| 2% Increase (Nozzle) | 1794.9 psia (126.1 Kg/cm$^2$) | 1801.8 psia (126.68 Kg/cm$^2$) |

TABLE 2

| | (NUMBER 4 VALVE) | |
|---|---|---|
| | IMPULSE CHAMBER PRESSURE | |
| BLADING AREA | CONSTANT P | SLIDING P |
| Drawing Values | 1228.5 psia (86.372 Kg/cm$^2$) | 1248.3 psia (87.764 Kg/cm$^2$) |
| 5% Increase (Reaction to Blading) | 1200.7 psia (84.417 Kg/cm$^2$) | 1220.7 psia (85.824 Kg/cm$^2$) |
| 2% Increase (Nozzle) | 1256.3 psia (88.326 Kg/cm$^2$) | 1275.9 psia (89.705 Kg/cm$^2$) |

A correlation was developed that closely predicted the optimum impulse chamber pressure at the transition point by utilizing the measured impulse chamber pressure when a particular valve is about to begin closing and the measured pressure just before the next valve begins to close during constant throttle pressure operation. The optimum impulse chamber pressure for all three sets of flow areas was practically a constant percentage of the differences in impulse chamber pressure, $\Delta P_{ic}$, at the two levels of load and flow for a given valve when it begins to close and is closed.

For the three cases, the multiplier to $\Delta P_{ic}$ varied between 53.4% and 54.1% for the sixth valve and between 74.0% and 76.8% for the fourth valve.

If the percentage that was used corresponded to the design areas of the turbine, the estimated impulse chamber pressures, Pest, at the sixth valve and the fourth valve for both constant and sliding throttle pressure operation are as follows in Tables 3 and 4, respectively. Pact is the calculated impulse chamber pressure from the turbine performance computer program.

TABLE 3

| Condition | (SIXTH VALVE) Pest | Pact |
|---|---|---|
| | Constant Pressure | |
| As Designed | 1780.1 psia (125.13 Kg/cm$^2$) | 1780.1 psia (125.13 Kg/cm$^2$) |
| 5% Area (Reaction) | 1763.0 psia (123.95 Kg/cm$^2$) | 1761.9 psia (123.87 Kg/cm$^2$) |
| 2% Area (Nozzle) | 1795.7 psia (126.25 Kg/cm$^2$) | 1794.8 psia (126.19 Kg/cm$^2$) |
| | Sliding Pressure | |
| As Designed | 1787.9 psia (125.70 Kg/cm$^2$) | 1787.1 psia (125.65 Kg/cm$^2$) |
| 5% Area (Reaction) | 1770.6 psia (124.49 Kg/cm$^2$) | 1769.1 psia (124.38 Kg/cm$^2$) |
| 2% Area (Nozzle) | 1803.5 psia (126.80 Kg/cm$^2$) | 1801.8 psia (126.68 Kg/cm$^2$) |

TABLE 4

| Condition | (FOURTH VALVE) Pest | Pact |
|---|---|---|
| | Constant Pressure | |
| As Designed | 1228.5 psia (86.372 Kg/cm$^2$) | 1228.5 psia (86.372 Kg/cm$^2$) |
| 5% Area (Reaction) | 1204.5 psia (84.685 Kg/cm$^2$) | 1200.7 psia (84.417 Kg/cm$^2$) |
| 2% Area (Nozzle) | 1251.3 psia (87.975 Kg/cm$^2$) | 1256.3 psia (88.326 Kg/cm$^2$) |
| | Sliding Pressure | |
| As Designed | 1251.0 psia (87.954 Kg/cm$^2$) | 1248.3 psia (87.764 Kg/cm$^2$) |
| 5% Area (Reaction) | 1226.5 psia (86.231 Kg/cm$^2$) | 1220.7 psia (85.814 Kg/cm$^2$) |
| 2% Area (Nozzle) | 1274.2 psia (89.585 Kg/cm$^2$) | 1275.9 psia (89.705 Kg/cm$^2$) |

If the as-manufactured flow areas for the reaction blading and the control stage nozzles were used in the turbine performance prediction program, the results would have been closer to the comparison identified as "As Designed". Because the proposed method uses the actual (measured) change in impulse chamber pressure from field data, the calculated transition points will be accurate. Consequently, any change in steam conditions or degradation of the turbine will be accounted for by the analysis. Both conditions would cause a change in impulse chamber pressure and temperature. To evaluate the effect of field measurements, the square root of the PV product was calculated for two conditions. In the first, the temperatures were assumed to be the predicted values. In the second, the temperatures were assumed to be 10° F. (5.6° C.) lower than either predicted or measured. The difference between the two square roots when using PV at the wrong temperature was about 0.025%, 1.01639 vs. 1.01665. Since both temperatures differed by 10° F. (5.6° C.), the errors practically canceled each other out.

There are a number of approaches for determining the square root of the two PV terms. One way is to use the design value. Another is to use the as-built values of area and then calculate the square root from the constant and sliding pressure PV product obtained from turbine performance calculations. Still another approach would be to use the measured impulse chamber temperature, $T_{ic}$, at the constant pressure transition point (impulse chamber pressure). Then, holding load constant, reduce throttle pressure. This will cause the valve to open. When the valve is fully open, measure the impulse chamber temperature and pressure.

The specific volume is then calculated from the two sets of pressures and temperatures using steam properties formulations. The controller 96 includes MicroVax computer which can perform this calculation. If the control system does not include algorithms for steam properties, then an empirical equation can be used which first calculates enthalpy, h, as a function of pressure and temperature and then calculates PV as a function of enthalpy for various levels of pressure. These equations are presented in U.S. Pat. No. 4,827,429 for "Turbine Impulse Chamber Temperature Determination Method and Apparatus" by George J. Silvestri, Jr. The on-line updating with this latter approach would allow the adjustment of the transition point to compensate for equipment deterioration and other deviations.

Using the suggested method for the three cases (design area, 5% excess reaction blading area, and 2% excess nozzle area), calculations were made to determine the increase in heat rate from the optimum by the use of the approximations. The heat rate error resulting from the incorrect transition point was less than 1 Btu/Kwh (1Kj/Kwh) for the sixth valve and between 0.7 Btu/Kwh (0.7 Kj/Kwh) and 2 Btu/Kwh (2Kj/Kwh) for the fourth valve. The 2 Btu/Kwh (2Kj/Kwh) deviation occurred with sliding pressure operation at the transition point. With constant pressure operation at this same point, the deviation was 0.7 Btu/Kwh (0.7Kj/Kwh).

Figure 2:
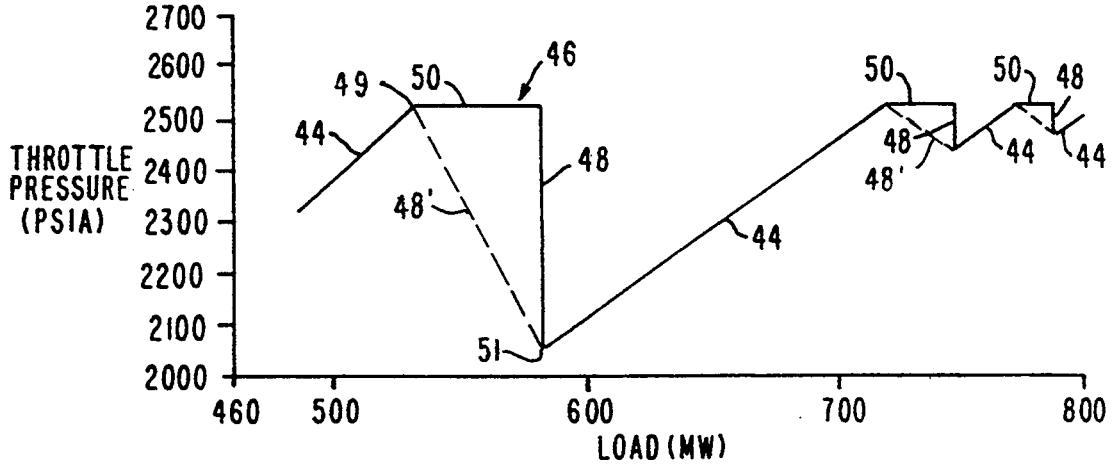
FIG. 2 illustrates throttle pressure as a function of load for the method of FIG. 1.
Figure 3:
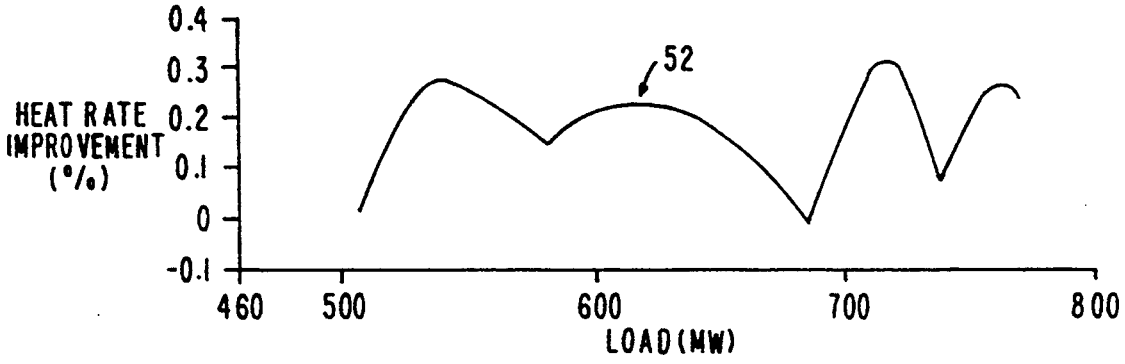
FIG. 3 PRIOR ART
FIG. 3 illustrates calculated efficiency improvement for the method of FIG. 1.

While the invention thus far described provides a method for establishing an optimum transition point for transitioning from variable pressure operation to constant pressure operation during variable operation of the steam turbine, additional improvement can be achieved by the manner in which the pressure and control valve closing are regulated subsequent to reaching the optimum transition point. Referring again to FIG. 2, it can be seen that at each transition point under prior art operation, the pressure was rapidly increased back to the nominal turbine operating pressure and held at that point while the control valves were closed from the transition point in order to reduce the load output of the turbine. Once a particular control valve has been fully closed, the variable pressure operation is again utilized to reduce turbine power output. At each transition point, there is a significant thermal stress placed on the rotor and also on the first stage control blading by the rapid increase of throttle pressure. Applicant now proposes to minimize this thermal stress and shock loading of the control stage blading by allowing the steam pressure or throttle pressure to increase gradually from its minimum value at the transition point up to its nominal operating value, reaching the nominal value only at the point at which the control valve associated with the particular control loop being followed has reached its minimum opening or fully closed position. FIG. 2 illustrates this improved operation with the dashed lines 48'.

Concurrently with this gradual increase in throttle steam pressure, the associated control valve is also allowed to begin to gradually close, starting from its fully opened position. In this mode of operation, there may be a particular point at which the control valve is closed by some small percentage such as, for example, 20%, and the throttle pressure is held at some value between the value at the optimum transition point and the nominal steam pressure value. It should be noted also that this method of operation may be utilized for either closure of a single control valve or closing of multiple control valves. It is believed that a heat rate improvement would be achieved by operating the turbine in this manner between transition points.

Using the above mode of operation, throttle pressure would increase linearly as the impulse pressure decreases between a transition point and a valve point. For example, in FIG. 2, a valve point is indicated at 49 and a transition point is indicated at 51. The turbine would operate with variable pressure operation over the entire range of admission with the pressure decreasing as load is decreased from a valve point such as valve point 49. Pressure would reach a minimum value at a transition point and then increase to its nominal value when the next lower valve point is reached.

The above described method of operation produces a more gradual change in first stage exit temperature and boiler drum temperature along with a heat rate improvement and reduction in shock loading of first stage blading. The heat rate improvement involves a tradeoff between the cycle available energy which is greater at higher pressure, the variation in first stage efficiency as its pressure ratio changes, and the variation in partial admission losses.

It may be noted that with the above described method of operation, a variation in the procedure for determining the optimum transition point could be utilized without sacrificing a significant heat rate improvement. In particular, since the variable pressure operation would be utilized throughout the reduced power cycle of a turbine, the transition point could be selected to be a predetermined percentage of the pressure difference between two adjacent valve points without the necessity of determining the constant pressure operation first stage exit pressure at the transition point and then modifying it to obtain the variable pressure operation pressure by using the square root of the two pressure volume terms or absolute temperatures.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the claims which follow.

What is claimed is:

1. A method for improving operational efficiency of a steam turbine power plant during power output variations, the plant including a partial-arc steam turbine selectively operable in a sliding pressure mode and a constant pressure mode, power variation in the constant pressure mode being effected by gradual valve closing and opening to vary steam flow to selected arcs of admission to thereby vary steam volume flow into the turbine, each arc of admission being defined by adjacent valve points corresponding to a fully open and a fully closed valve controlling steam admission to a respective one of the arcs of admission, sliding pressure operation being affected by varying steam pressure into a steam chest of the turbine, and efficiency being improved by using sliding pressure operation during at least some part of the power variation and constant pressure operation during another part of the power variation, the method comprising the steps of:

determining impulse chamber pressure at each of a plurality of valve points during operation of the steam turbine at constant pressure;

computing for each adjacent pair of valve points, an optimum constant pressure transition point between each pair of adjacent valve points for transitioning from a sliding pressure mode to a constant pressure mode;

converting the optimum constant pressure transition point to a corresponding sliding pressure transition value;

transitioning from sliding pressure operation to constant pressure operation when the impulse chamber pressure reaches the sliding pressure transition value; and increasing steam pressure concurrently with control valve closing beginning at the step of transitioning.

2. The method of claim 1, wherein the step of increasing steam pressure includes the step of increasing pressure at a rate such that nominal steam operating pressure is reached substantially concurrently with full closure of the control valve.

3. A method for reducing rotor thermal stress and shock loading of control stage blading in a partial-arc steam turbine in which steam flow is controlled to match power demand, the turbine including a plurality of control valves each arranged for admitting steam to a predetermined arc of admission at the control stage blading, the method comprising the steps of:

reducing steam pressure at the control valves to a predetermined value corresponding to a heat rate achievable by closing a first control valve to a predetermined steam flow value while operating at constant steam pressure;

gradually increasing steam pressure from said predetermined value to another value while closing said first control valve to a minimum flow position;

reducing steam pressure to another predetermined value corresponding to another heat rate achievable by closing another control valve to another predetermined steam flow value while operating at constant steam pressure;

gradually increasing steam pressure from said another predetermined value to said another value while closing said another control valve to a minimum flow position; and repeating the steps of reducing and increasing pressure and closing of the control valves until turbine power matches power demand.

4. The method of claim 8 wherein the heat rate is determined by the step of computing, for each adjacent pair of valve points, an optimum constant pressure transition point corresponding to an intersection point on a heat rate graph of a constant pressure valve loop and a sliding pressure plot.

* * * * *